US010631648B1

(12) United States Patent
Tsai

(10) Patent No.: US 10,631,648 B1
(45) Date of Patent: Apr. 28, 2020

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC. (TW)

( * ) Notice: Subject to any disclaimer, the term of this patent is extended or adjusted under 35 U.S.C. 154(b) by 0 days.

(21) Appl. No.: 16/280,111

(22) Filed: Feb. 20, 2019

(30) Foreign Application Priority Data

Dec. 27, 2018 (TW) ..... 107147385 A

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS 6,634,705 B1 * 10/2003 Zheng ..... A47C 4/286 297/41
7,073,852 B1 * 7/2006 Zheng ..... A47C 4/286 297/16.2
2011/0006564 A1 * 1/2011 Lougee ..... A47C 4/286 297/41
2011/0006565 A1 * 1/2011 Lougee ..... A47C 7/46 297/59
2016/0100688 A1 * 4/2016 Grace ..... A47C 4/286 297/17
2019/0110599 A1 * 4/2019 Grace ..... A47C 4/44
2019/0216222 A1 * 7/2019 Winterhalter ..... A47C 4/286

FOREIGN PATENT DOCUMENTS

JP 3145676 U * 10/2008 ..... A47C 4/286
JP 2014184013 A * 10/2014 ..... A47C 4/286
WO WO-2013023365 A1 * 2/2013 ..... A47C 4/286

* cited by examiner

*Primary Examiner* — Timothy J Brindley

(74) *Attorney, Agent, or Firm* — Schmeiser, Olsen & Watts LLP

(57) ABSTRACT

A folding chair includes a left lateral folding mechanism, a left handrail mechanism, a right lateral folding mechanism, a right handrail mechanism, a front supporting mechanism, a rear supporting mechanism and a load-bearing structure. Therefore, the folding chair can be folded up like an umbrella and thus takes up little space and is portable and can be unfolded to demonstrate high stability and high load-bearing capability.

10 Claims, 4 Drawing Sheets

FOLDING CHAIR

CROSS-REFERENCE TO RELATED APPLICATION

This non-provisional application claims priority under 35 U.S.C. § 119(a) on Patent Application No(s). 107147385 filed in Taiwan, R.O.C. on Dec. 27, 2018, the entire contents of which are hereby incorporated by reference.

FIELD OF THE INVENTION

The present disclosure relates to folding chairs and, more particularly, to a folding chair not only capable of being folded and stored but also capable of being unfolded and used.

BACKGROUND OF THE INVENTION

A conventional folding chair consists of a frame, two legs, a pad and a back rest. The legs movably cross the frame to fit thereto. The pad movably fits to the frame. The back rest is mounted on the top of the frame. Therefore, the legs and the pad are unfolded on one side of the frame such that a sitter can sit on the pad. Alternatively, the legs and the pad can press against each other toward the frame, thereby allowing the folding chair to be folded.

However, the conventional folding chair has drawbacks described below. Folding the conventional folding chair involves pressing the legs and the pad against each other toward the frame; as a result, the width of the frame and the width of the pad remain unchanged, regardless of whether the conventional folding chair is folded or unfolded, and thus the conventional folding chair takes up much space and is not portable. Furthermore, after the folding chair has been unfolded, only the bottom of the frame and the legs are in contact with the ground to bear the weight of the folding chair, thereby compromising the stability and load-bearing capability of the folding chair.

Therefore, it is imperative to provide a folding chair which can be folded up like an umbrella and thus takes up little space and is portable and can be unfolded to demonstrate high stability and high load-bearing capability.

SUMMARY OF THE INVENTION

In view of the aforesaid drawbacks of the prior art, it is an objective of the present disclosure to provide a folding chair which can be folded up like an umbrella and thus takes up little space and is portable and can be unfolded to demonstrate high stability and high load-bearing capability.

In order to achieve the above and other objectives, the present disclosure provides a folding chair comprising a left lateral folding mechanism, a left handrail mechanism, a right lateral folding mechanism, a right handrail mechanism, a front supporting mechanism, a rear supporting mechanism and a load-bearing structure. The left lateral folding mechanism comprises a left frame rod, a left frame rotating element, a left rear leg sliding element, a left rear leg rod, a left rear leg fixing element, a left back rest rod, a left back rest rod sliding element, a left front leg rod, a left front leg terminal, a left connecting rod and a left rear leg terminal. The left frame rotating element being movably coupled to the vicinity of one end of the left frame rod, the left rear leg sliding element being movably coupled to the other end of the left frame rod, the left rear leg rod being movably, penetratingly disposed at the left rear leg sliding element, the left rear leg fixing element being movably coupled to one end of the left rear leg rod, the left back rest rod having one end movably coupled to the left frame rod, the left rear leg fixing element being disposed at the vicinity of one end of the left back rest rod, the left back rest rod sliding element being movably fitted to the left back rest rod, the left front leg rod having one end movably coupled to the left back rest rod sliding element, the left front leg terminal being movably coupled to the other end of the left front leg rod, the left connecting rod having one end movably coupled to the left rear leg rod, the left connecting rod having the other end movably coupled between the left frame rod and the left front leg rod, the left rear leg terminal being movably coupled to the other end of the left rear leg rod; the left handrail mechanism being connected to the left lateral folding mechanism, the left handrail mechanism comprising a left handrail rod, a left handrail fixing element, a left handrail supporting rod and a left supporting rod sliding element, the left handrail rod having one end movably coupled to the left back rest rod, the left frame rotating element being disposed at the left handrail supporting rod, the left handrail fixing element being disposed at the vicinity of the other end of the left handrail rod, the left handrail supporting rod having one end movably coupled to the left handrail fixing element, the left supporting rod sliding element being coupled to the other end of the left handrail supporting rod, the left supporting rod sliding element being movably fitted to the left front leg rod; the right lateral folding mechanism being opposingly disposed on one side of the left lateral folding mechanism, the right lateral folding mechanism comprises a right frame rod, a right frame rotating element, a right rear leg sliding element, a right rear leg rod, a right rear leg fixing element, a right back rest rod, a right back rest rod sliding element, a right front leg rod, a right front leg terminal, a right connecting rod and a right rear leg terminal, the right frame rotating element being movably coupled to the vicinity of one end of the right frame rod, the right rear leg sliding element being movably coupled to the other end of the right frame rod, the right rear leg rod being movably, penetratingly disposed at the right rear leg sliding element, the right rear leg fixing element being movably coupled to one end of the right rear leg rod, the right back rest rod having one end movably coupled to the right frame rod, the right rear leg fixing element being disposed at the vicinity of one end of the right back rest rod, the right back rest rod sliding element being movably fitted to the right back rest rod, the right front leg rod having one end movably coupled to the right back rest rod sliding element, the right front leg terminal being movably coupled to the other one end of the right front leg rod, the right connecting rod having one end movably coupled to the right rear leg rod, the right connecting rod having the other end movably coupled between the right frame rod and the right front leg rod, the right rear leg terminal being movably coupled to the other end of the right rear leg rod; the right handrail mechanism being connected to the right lateral folding mechanism and opposing the left handrail mechanism, the right handrail mechanism comprising a right handrail rod, a right handrail fixing element, a right handrail supporting rod and a right supporting rod sliding element, the right handrail rod having one end movably coupled to the right back rest rod, the right frame rotating element being disposed at the right handrail supporting rod, the right handrail fixing element being disposed at the vicinity of the other end of the right handrail rod, the right handrail supporting rod having one end movably coupled to the right handrail fixing element, the right supporting rod sliding element being coupled to the other end of the right handrail supporting rod, and the right supporting rod sliding element being movably fitted to the right front leg rod; the front supporting mechanism being disposed between the left lateral folding mechanism and the right lateral folding mechanism, the front supporting mechanism comprising a first front supporting rod and a second front supporting rod, wherein the first front supporting rod and the second front supporting rod cross each other so as to be movably coupled together, the first front supporting rod having one end movably coupled to the left frame rotating element, the first front supporting rod having the other end movably coupled to the right front leg terminal, the second front supporting rod having one end movably coupled to the right frame rotating element, the second front supporting rod having the other end movably coupled to the left front leg terminal; the rear supporting mechanism being disposed between the left lateral folding mechanism and the right lateral folding mechanism, the rear supporting mechanism comprising a first rear supporting rod and a second rear supporting rod, wherein the first rear supporting rod and the second rear supporting rod cross each other so as to be movably coupled together, the first rear supporting rod having one end movably coupled to the left back rest rod sliding element, the first rear supporting rod having the other end movably coupled to the right rear leg terminal, the second rear supporting rod having one end movably coupled to the right back rest rod sliding element, the second rear supporting rod having the other end movably coupled to the left rear leg terminal; the load-bearing structure being disposed at the left lateral folding mechanism and the right lateral folding mechanism.

In an embodiment of the folding chair, the left frame rotating element has a first pivotal connection portion and a first straddling portion, the first straddling portion being disposed on the top surface of the first pivotal connection portion, the first front supporting rod having one end movably coupled to the first pivotal connection portion, and the left frame rod being movably coupled to the first straddling portion.

In an embodiment of the folding chair, the left rear leg sliding element has a first fitting portion and a second pivotal connection portion, the second pivotal connection portion being disposed at one end of the first fitting portion, the left rear leg rod being movably, penetratingly disposed at the first fitting portion, and the left frame rod having the other end movably coupled to the second pivotal connection portion.

In an embodiment of the folding chair, the left rear leg fixing element has a second securing portion and a third pivotal connection portion, the second securing portion being disposed at one end of the third pivotal connection portion, the second securing portion being coupled to the vicinity of one end of the left back rest rod, and the left rear leg rod having one end movably coupled to the third pivotal connection portion.

In an embodiment of the folding chair, the left back rest rod sliding element has a second fitting portion, a fourth pivotal connection portion and a fifth pivotal connection portion, the fourth pivotal connection portion being disposed at one end of the second fitting portion, the fifth pivotal connection portion being disposed on one side of the second fitting portion, the left back rest rod being movably, penetratingly disposed at the second fitting portion, the left front leg rod having one end movably coupled to the fourth pivotal connection portion, and the first rear supporting rod having one end movably coupled to the fifth pivotal connection portion.

In an embodiment of the folding chair, the right frame rotating element has a sixth pivotal connection portion and a second straddling portion, the second straddling portion being disposed on the top surface of the sixth pivotal connection portion, the second front supporting rod having one end movably coupled to the sixth pivotal connection portion, and the right frame rod being movably coupled to the second straddling portion.

In an embodiment of the folding chair, the right rear leg sliding element has a third fitting portion and a seventh pivotal connection portion, the seventh pivotal connection portion being disposed at one end of the third fitting portion, the right rear leg rod being movably, penetratingly disposed at the third fitting portion, and the right frame rod having the other end movably coupled to the seventh pivotal connection portion.

In an embodiment of the folding chair, the right rear leg fixing element has a fourth securing portion and an eighth pivotal connection portion, the fourth securing portion being disposed at one end of the eighth pivotal connection portion, the fourth securing portion being coupled to the vicinity of one end of the right back rest rod, and the right rear leg rod having one end movably coupled to the eighth pivotal connection portion.

In an embodiment of the folding chair, the right back rest rod sliding element has a fourth fitting portion, a ninth pivotal connection portion and a tenth pivotal connection portion, the ninth pivotal connection portion being disposed at one end of the fourth fitting portion, the tenth pivotal connection portion being disposed on one side of the fourth fitting portion, the right back rest rod being movably, penetratingly disposed at the fourth fitting portion, the right front leg rod having one end movably coupled to the ninth pivotal connection portion, and the second rear supporting rod having one end movably coupled to the tenth pivotal connection portion.

In an embodiment of the folding chair, the load-bearing structure comprises a sitting portion and a back rest portion, the sitting portion being disposed at the left frame rod and the right frame rod, the back rest portion being disposed at the left back rest rod and the right back rest rod, and the back rest portion being connected to the sitting portion.

Therefore, the folding chair of the present disclosure can be folded up like an umbrella and thus takes up little space and is portable and can be unfolded to demonstrate high stability and high load-bearing capability.

DETAILED DESCRIPTION OF THE PREFERRED EMBODIMENTS

Figure 1:
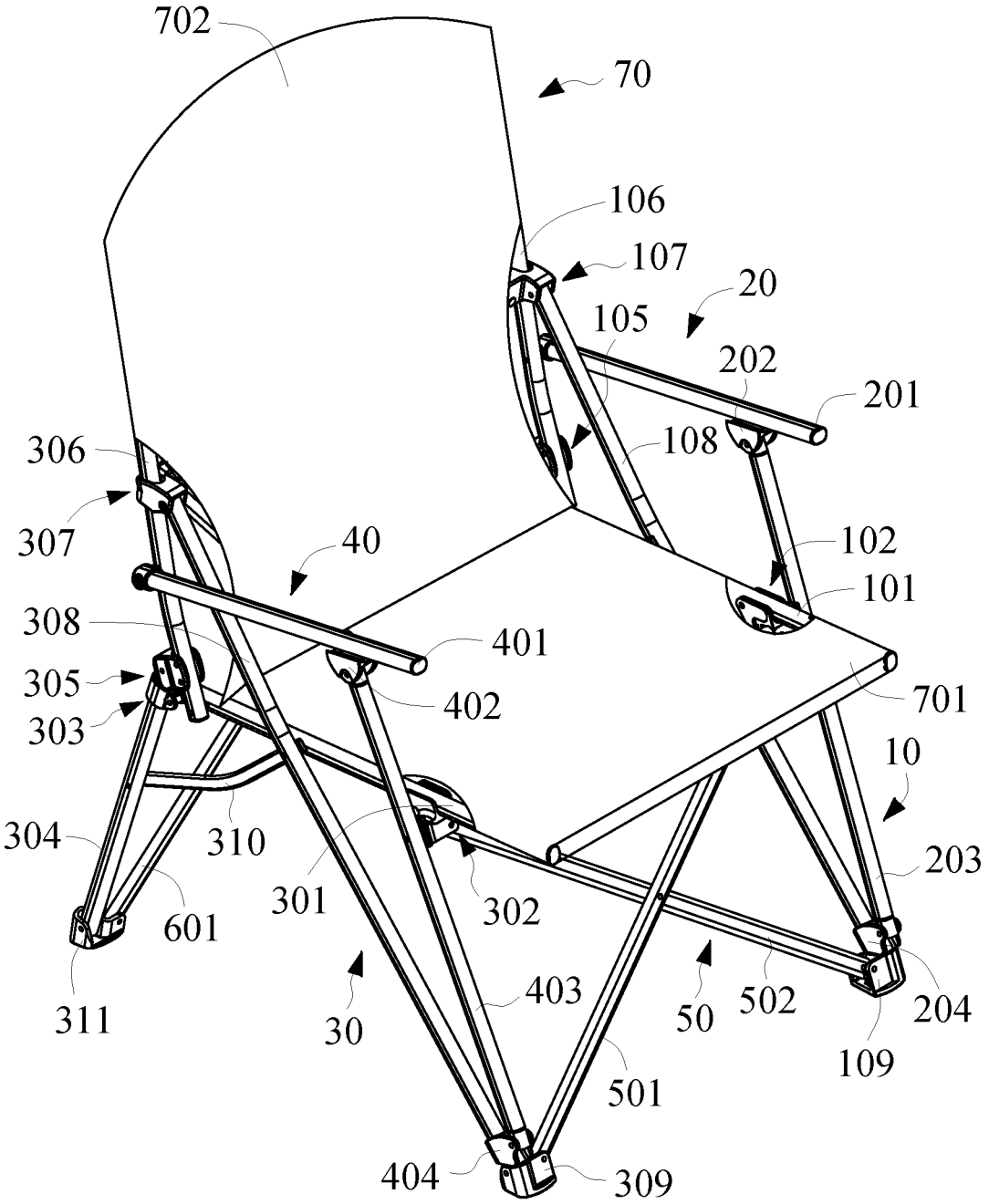
FIG. 1 is a schematic view of a folding chair unfolded according to the present disclosure.

Objectives, features, and advantages of the present disclosure are hereunder illustrated with specific embodiments, depicted with drawings, and described below.

Referring to FIG. 1 through FIG. 4, the present disclosure provides a folding chair comprising a left lateral folding mechanism 10, a left handrail mechanism 20, a right lateral folding mechanism 30, a right handrail mechanism 40, a front supporting mechanism 50, a rear supporting mechanism 60 and a load-bearing structure 70.

The left lateral folding mechanism 10 comprises a left frame rod 101, a left frame rotating element 102, a left rear leg sliding element 103, a left rear leg rod 104, a left rear leg fixing element 105, a left back rest rod 106, a left back rest rod sliding element 107, a left front leg rod 108, a left front leg terminal 109, a left connecting rod 110 and a left rear leg terminal 111. The left frame rotating element 102 is movably coupled to the vicinity of one end of the left frame rod 101. The left rear leg sliding element 103 is movably coupled to the other end of the left frame rod 101. The left rear leg rod 104 is movably, penetratingly disposed at the left rear leg sliding element 103. The left rear leg fixing element 105 is movably coupled to one end of the left rear leg rod 104. The left back rest rod 106 has one end movably coupled to the left frame rod 101. The left rear leg fixing element 105 is disposed at the vicinity of one end of the left back rest rod 106. The left back rest rod sliding element 107 is movably fitted to the left back rest rod 106. The left front leg rod 108 has one end movably coupled to the left back rest rod sliding element 107. The left front leg terminal 109 is movably coupled to the other end of the left front leg rod 108. The left connecting rod 110 has one end movably coupled to the left rear leg rod 104. The left connecting rod 110 has the other end movably coupled between the left frame rod 101 and the left front leg rod 108. The left rear leg terminal 111 is movably coupled to the other end of the left rear leg rod 104.

The left handrail mechanism 20 is connected to the left lateral folding mechanism 10. The left handrail mechanism 20 comprises a left handrail rod 201, a left handrail fixing element 202, a left handrail supporting rod 203 and a left supporting rod sliding element 204. The left handrail rod 201 has one end movably coupled to the left back rest rod 106. The left frame rotating element 102 is disposed at the left handrail supporting rod 203. The left handrail fixing element 202 is disposed at the vicinity of the other end of the left handrail rod 201. The left handrail supporting rod 203 has one end movably coupled to the left handrail fixing element 202. The left supporting rod sliding element 204 is coupled to the other end of the left handrail supporting rod 203. The left supporting rod sliding element 204 is movably fitted to the left front leg rod 108.

The right lateral folding mechanism 30 is opposingly disposed on one side of the left lateral folding mechanism 10. The right lateral folding mechanism 30 comprises a right frame rod 301, a right frame rotating element 302, a right rear leg sliding element 303, a right rear leg rod 304, a right rear leg fixing element 305, a right back rest rod 306, a right back rest rod sliding element 307, a right front leg rod 308, a right front leg terminal 309, a right connecting rod 310 and a right rear leg terminal 311. The right frame rotating element 302 is movably coupled to the vicinity of one end of the right frame rod 301. The right rear leg sliding element 303 is movably coupled to the other end of the right frame rod 301. The right rear leg rod 304 is movably, penetratingly disposed at the right rear leg sliding element 303. The right rear leg fixing element 305 is movably coupled to one end of the right rear leg rod 304. The right back rest rod 306 has one end movably coupled to the right frame rod 301. The right rear leg fixing element 305 is disposed at the vicinity of one end of the right back rest rod 306. The right back rest rod sliding element 307 is movably fitted to the right back rest rod 306. The right front leg rod 308 has one end movably coupled to the right back rest rod sliding element 307. The right front leg terminal 309 is movably coupled to the other end of the right front leg rod 308. The right connecting rod 310 has one end movably coupled to the right rear leg rod 304. The right connecting rod 310 has the other end movably coupled between the right frame rod 301 and the right front leg rod 308. The right rear leg terminal 311 is movably coupled to the other end of the right rear leg rod 304.

The right handrail mechanism 40 is connected to the right lateral folding mechanism 30 and opposes the left handrail mechanism 20. The right handrail mechanism 40 comprises a right handrail rod 401, a right handrail fixing element 402, a right handrail supporting rod 403 and a right supporting rod sliding element 404. The right handrail rod 401 has one end movably coupled to the right back rest rod 306. The right frame rotating element 302 is disposed at the right handrail supporting rod 403. The right handrail fixing element 402 is disposed at the vicinity of the other end of the right handrail rod 401. The right handrail supporting rod 403 has one end movably coupled to the right handrail fixing element 402. The right supporting rod sliding element 404 is coupled to the other end of the right handrail supporting rod 403. The right supporting rod sliding element 404 is movably fitted to the right front leg rod 308.

The front supporting mechanism 50 is disposed between the left lateral folding mechanism 10 and the right lateral folding mechanism 30. The front supporting mechanism 50 comprises a first front supporting rod 501 and a second front supporting rod 502. The first front supporting rod 501 and the second front supporting rod 502 cross each other so as to be movably coupled together. The first front supporting rod 501 has one end movably coupled to the left frame rotating element 102. The first front supporting rod 501 has the other end movably coupled to the right front leg terminal 309. The second front supporting rod 502 has one end movably coupled to the right frame rotating element 302. The second front supporting rod 502 has the other end movably coupled to the left front leg terminal 109.

The rear supporting mechanism 60 is disposed between the left lateral folding mechanism 10 and the right lateral folding mechanism 30. The rear supporting mechanism 60 comprises a first rear supporting rod 601 and a second rear supporting rod 602. The first rear supporting rod 601 and the second rear supporting rod 602 cross each other so as to be movably coupled together. The first rear supporting rod 601 has one end movably coupled to the left back rest rod sliding element 107. The first rear supporting rod 601 has the other end movably coupled to the right rear leg terminal 311. The second rear supporting rod 602 has one end movably coupled to the right back rest rod sliding element 307. The second rear supporting rod 602 has the other end movably coupled to the left rear leg terminal 111.

The load-bearing structure 70 is disposed at the left lateral folding mechanism 10 and the right lateral folding mechanism 30. The load-bearing structure 70 is made of a soft material, such as fabric or plastic.

Figure 2:
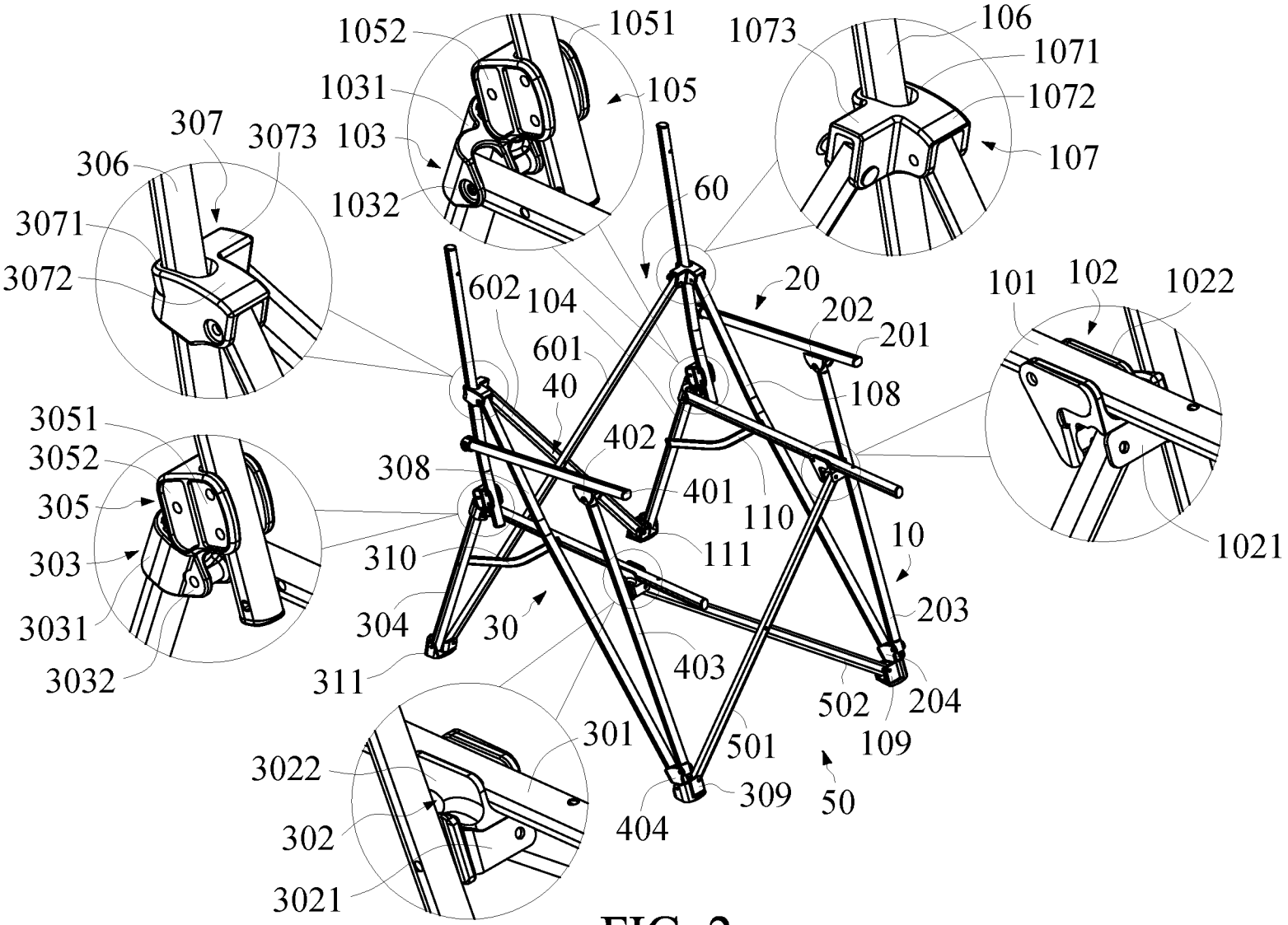
FIG. 2 is a schematic view of the folding chair unfolded according to the present disclosure, but not showing a load-bearing structure.
Figure 3:
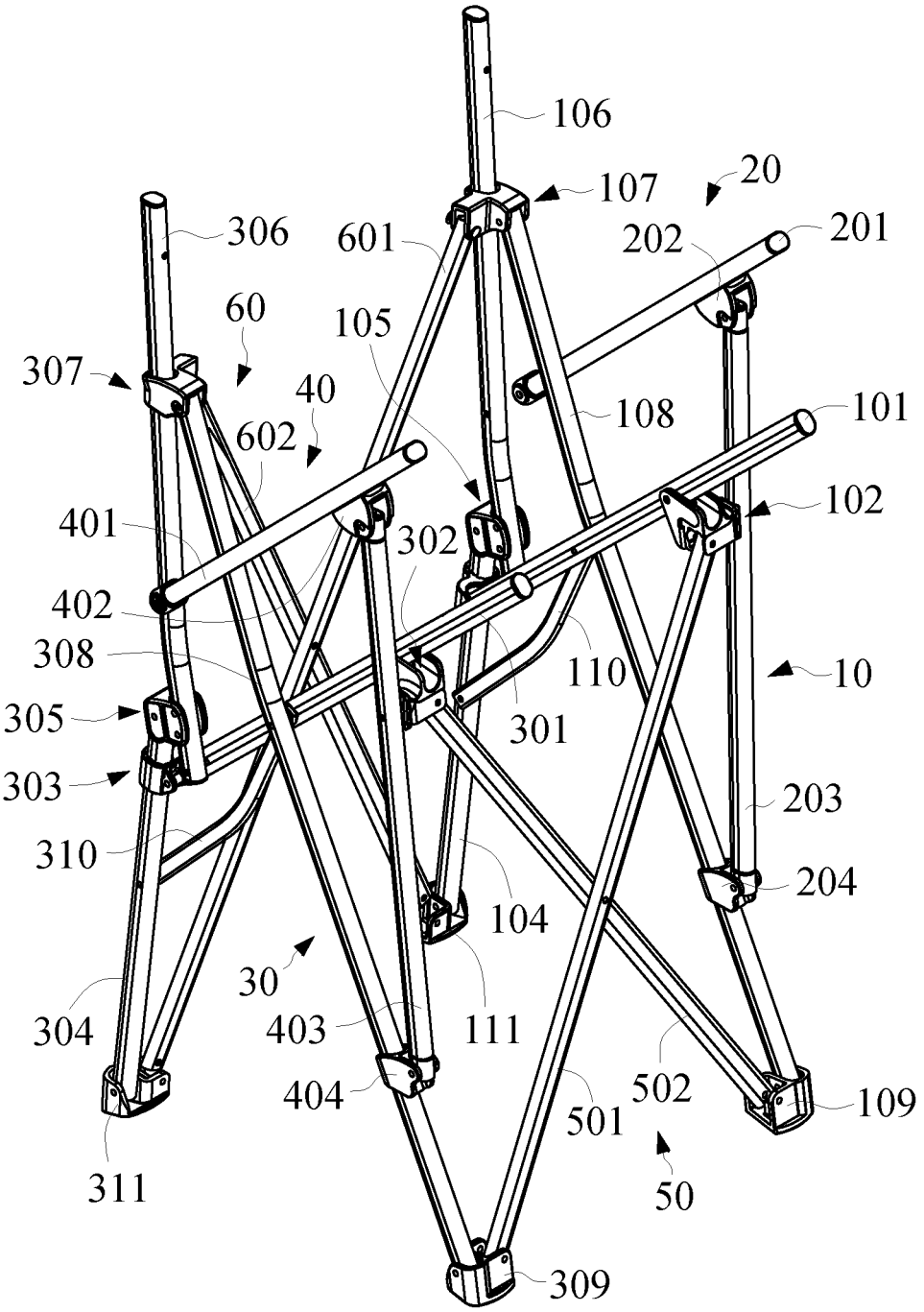
FIG. 3 is a schematic view of the folding chair folded according to the present disclosure, but not showing the load-bearing structure.
Figure 4:
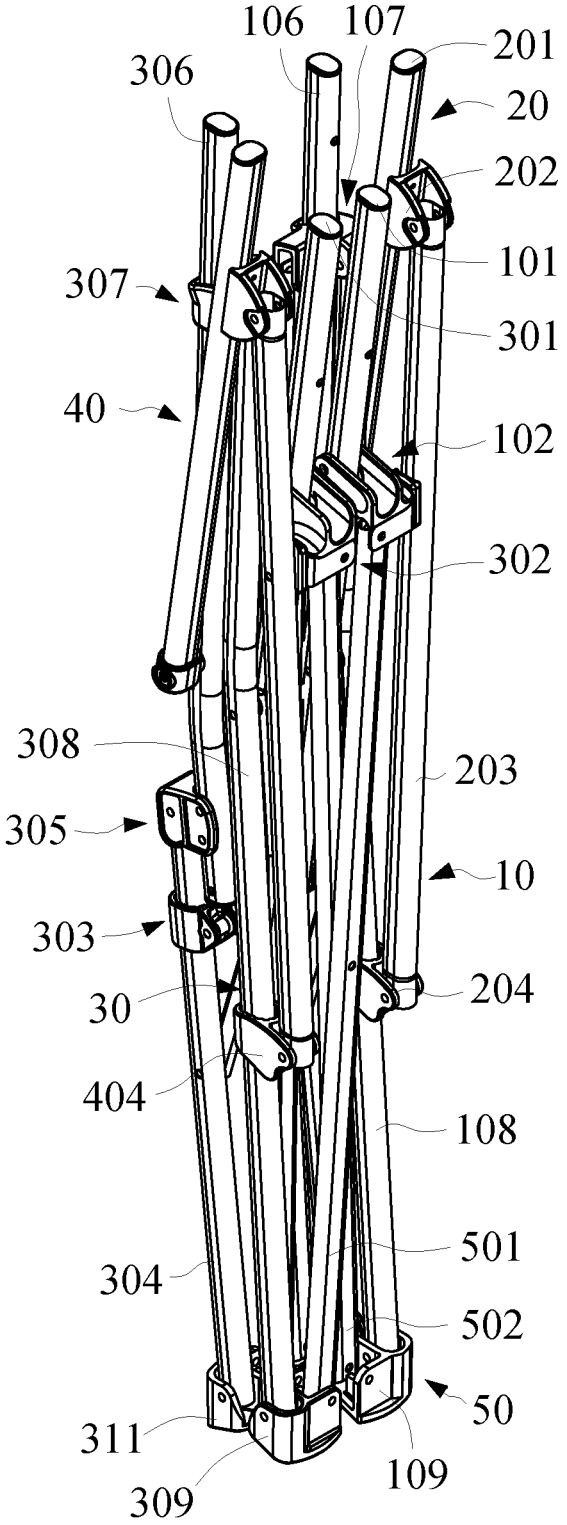
FIG. 4 is another schematic view of the folding chair folded according to the present disclosure, but not showing the load-bearing structure.

Referring to FIG. 2 through FIG. 4, to fold the folding chair, a user grips one end of the left back rest rod 106 (or the right back rest rod 306) and one end of the left frame rod 101 (or the right frame rod 301) simultaneously and then moves the left frame rod 101 toward the left back rest rod 106 such that the left frame rod 101 moves away from the left frame rotating element 102 and rotates about the left front leg rod 108. Furthermore, the left frame rotating element 102 drives the left handrail supporting rod 203 upward while the first front supporting rod 501 moves above the right front leg terminal 309 and toward the right lateral folding mechanism 30. Furthermore, the left rear leg sliding element 103 slides downward along the left rear leg rod 104 such that the left rear leg rod 104 moves above the left rear leg fixing element 105 and toward the right lateral folding mechanism 30. Furthermore, the left back rest rod 106 moves toward the right lateral folding mechanism 30 such that the left back rest rod sliding element 107 slides upward along the left back rest rod 106. Owing to the left connecting rod 110, the left front leg rod 108 moves toward the left rear leg rod 104 such that the first rear supporting rod 601 moves above the right rear leg terminal 311 and toward the right lateral folding mechanism 30. The supporting rod sliding element 204 slides upward above the left front leg rod 108. Owing to the left handrail supporting rod 203 and the left handrail fixing element 202, the left handrail rod 201 moves toward the left back rest rod 106. While the left lateral folding mechanism 10 is operating as described above, the right lateral folding mechanism 20 causes the right frame rod 301 to move toward the right back rest rod 306 such that the right frame rod 301 moves away from the right frame rotating element 302 and rotates about the right front leg rod 308. Furthermore, the right frame rotating element 302 drives the right handrail supporting rod 403 upward. While the right handrail supporting rod 403 is moving upward, the second front supporting rod 502 moves above the left front leg terminal 109 and toward the left lateral folding mechanism 10. The right rear leg sliding element 303 slides downward along the right rear leg rod 304 so as to drive the right rear leg rod 304 above the right rear leg fixing element 305 and toward the left lateral folding mechanism 10. The right back rest rod 306 moves toward the left lateral folding mechanism 10 such that the right back rest rod sliding element 307 slides upward along the right back rest rod 306 to not only drive, in conjunction with the right connecting rod 310, the right front leg rod 308 toward the right rear leg rod 304 but also drive the second rear supporting rod 602 toward the left lateral folding mechanism 10 along the left rear leg terminal 111 and cause the supporting rod sliding element 304 to slide upward along the right front leg rod 308. Owing to the right handrail supporting rod 403 and the right handrail fixing element 402, the right handrail rod 401 moves toward the right back rest rod 306. Therefore, the folding chair can be folded up like an umbrella and thus takes up little space and is portable.

In the course of folding or unfolding the folding chair, the left front leg terminal 109, the left rear leg terminal 111, the right front leg terminal 309 and the right rear leg terminal 311 provide protection to the left front leg rod 108, the second front supporting rod 502, the left rear leg rod 104, the second rear supporting rod 602, the right front leg rod 308, the first front supporting rod 501, the right rear leg rod 304 and the first rear supporting rod 601, respectively, to not only prevent them from coming into direct contact with the ground and thus getting damaged, but also render them resistant to slipping such that the left lateral folding mechanism 10 and the right lateral folding mechanism 30 demonstrate high stability and high load-bearing capability.

In an embodiment of the present disclosure, as shown in FIG. 2 through FIG. 4, the left frame rotating element 102 has a first pivotal connection portion 1021 and a first straddling portion 1022. The first straddling portion 1022 is disposed on the top surface of the first pivotal connection portion 1021. The first front supporting rod 501 has one end movably coupled to the first pivotal connection portion 1021. The left frame rod 101 is movably coupled to the first straddling portion 1022. Therefore, to unfold the folding chair, the user moves the left frame rod 101 into the first straddling portion 1022 to fit them together and uses the first pivotal connection portion 1021 of the left frame rotating element 102 to drive the movement of the first front supporting rod 501, so as to not only allow the left frame rotating element 102 to easily drive the first front supporting rod 501 to move, but also enable the left frame rod 101 and the first front supporting rod 501 to demonstrate high stability and high load-bearing capability after the folding chair has been unfolded.

In an embodiment of the present disclosure, as shown in FIG. 2 through FIG. 4, the left rear leg sliding element 103 has a first fitting portion 1031 and a second pivotal connection portion 1032. The second pivotal connection portion 1032 is disposed at one end of the first fitting portion 1031. The left rear leg rod 104 is movably, penetratingly disposed at the first fitting portion 1031. The left frame rod 101 has the other end movably coupled to the second pivotal connection portion 1032. Therefore, regardless of whether the folding chair is folded or unfolded, the first fitting portion 1031 of the left rear leg sliding element 103 slides downward or upward along the left rear leg rod 104. Owing to the second pivotal connection portion 1032, the left frame rod 101 can be moved away from or moved to the first straddling portion 1022. Therefore, not only can the left rear leg sliding element 103 be moved smoothly, but the left frame rod 101 also demonstrates high stability and high load-bearing capability after the folding chair has been unfolded.

In an embodiment of the present disclosure, as shown in FIG. 2 through FIG. 4, the left rear leg fixing element 105 has a second securing portion 1051 and a third pivotal connection portion 1052. The second securing portion 1051 is disposed at one end of the third pivotal connection portion 1052. The second securing portion 1051 is coupled to the vicinity of one end of the left back rest rod 106. The left rear leg rod 104 has one end movably coupled to the third pivotal connection portion 1052. Therefore, regardless of whether the folding chair is folded or unfolded, owing to the third pivotal connection portion 1052, the left rear leg rod 104 moves toward the right lateral folding mechanism 30 or moves away from the right lateral folding mechanism 30. Owing to the second securing portion 1051 and the left back rest rod 106, not only can the left rear leg rod 104 move smoothly, but the left rear leg rod 104 and the left back rest rod 106 also demonstrate high stability and high load-bearing capability after the folding chair has been unfolded.

In an embodiment of the present disclosure, as shown in FIG. 2 through FIG. 4, the left back rest rod sliding element 107 has a second fitting portion 1071, a fourth pivotal connection portion 1072 and a fifth pivotal connection portion 1073. The fourth pivotal connection portion 1072 is disposed at one end of the second fitting portion 1071. The fifth pivotal connection portion 1073 is disposed on one side of the second fitting portion 1071. The left back rest rod 106 is movably, penetratingly disposed at the second fitting portion 1071. The left front leg rod 108 has one end movably coupled to the fourth pivotal connection portion 1072. The first rear supporting rod 601 has one end movably coupled to the fifth pivotal connection portion 1073. Therefore, regardless of whether the folding chair is folded or unfolded, the second fitting portion 1071 of the left back rest rod sliding element 107 slides downward or upward along the left back rest rod 106 to not only allow the left front leg rod 108 to move toward the left rear leg rod 104 or move away from the left rear leg rod 104 because of the fourth pivotal connection portion 1072 and the fifth pivotal connection portion 1073, but also allow the first rear supporting rod 601 to move toward the right lateral folding mechanism 30 or move away from the right lateral folding mechanism 30. Therefore, not only does the left back rest rod sliding element 107 move smoothly, but the left back rest rod 106, the left front leg rod 108 and the first rear supporting rod 601 also demonstrate high stability and high load-bearing capability after the folding chair has been unfolded.

In an embodiment of the present disclosure, as shown in FIG. 2 through FIG. 4, the right frame rotating element 302 has a sixth pivotal connection portion 3021 and a second straddling portion 3022. The second straddling portion 3022 is disposed on the top surface of the sixth pivotal connection portion 3021. The second front supporting rod 502 has one end movably coupled to the sixth pivotal connection portion 3021. The right frame rod 301 is movably coupled to the second straddling portion 3022. Therefore, to unfold the folding chair, the user moves the right frame rod 301 into the second straddling portion 3022 to fit them together and uses the sixth pivotal connection portion 3021 of the right frame rotating element 302 to drive the movement of the second front supporting rod 502, so as to not only allow the right frame rotating element 302 to easily drive the second front supporting rod 502 to move, but also enable the right frame rod 301 and the second front supporting rod 502 to demonstrate high stability and high load-bearing capability after the folding chair has been unfolded.

In an embodiment of the present disclosure, as shown in FIG. 2 through FIG. 4, the right rear leg sliding element 303 has a third fitting portion 3031 and a seventh pivotal connection portion 3032. The seventh pivotal connection portion 3032 is disposed at one end of the third fitting portion 3031. The right rear leg rod 304 is movably, penetratingly disposed at the third fitting portion 3031. The right frame rod 301 has the other end movably coupled to the seventh pivotal connection portion 3032. Therefore, regardless of whether the folding chair is folded or unfolded, the third fitting portion 3031 of the right rear leg sliding element 303 slides downward or upward along the right rear leg rod 304, whereas owing to the seventh pivotal connection portion 3032, the right frame rod 301 moves away from or moves to the second straddling portion 3022. Therefore, not only does the right rear leg sliding element 103 move smoothly, but the right frame rod 301 also demonstrates high stability and high load-bearing capability after the folding chair has been unfolded.

In an embodiment of the present disclosure, as shown in FIG. 2 through FIG. 4, the right rear leg fixing element 305 has a fourth securing portion 3051 and an eighth pivotal connection portion 3052. The fourth securing portion 3051 is disposed at one end of the eighth pivotal connection portion 3052. The fourth securing portion 3051 is coupled to the vicinity of one end of the right back rest rod 306. The right rear leg rod 304 has one end movably coupled to the eighth pivotal connection portion 3052. Therefore, regardless of whether the folding chair is folded or unfolded, owing to the eighth pivotal connection portion 3052, the right rear leg rod 304 moves toward the left lateral folding mechanism 10 or moves away from the left lateral folding mechanism 10. In addition, owing to the fourth securing portion 3051 and the right back rest rod 306, not only does the right rear leg rod 304 move smoothly, but the right rear leg rod 304 and the right back rest rod 306 also demonstrate high stability and high load-bearing capability after the folding chair has been unfolded.

In an embodiment of the present disclosure, as shown in FIG. 2 through FIG. 4, the right back rest rod sliding element 307 has a fourth fitting portion 3071, a ninth pivotal connection portion 3072 and a tenth pivotal connection portion 3073. The ninth pivotal connection portion 3072 is disposed at one end of the fourth fitting portion 3071. The tenth pivotal connection portion 3073 is disposed on one side of the fourth fitting portion 3071. The right back rest rod 306 is movably, penetratingly disposed at the fourth fitting portion 3071. The right front leg rod 308 has one end movably coupled to the ninth pivotal connection portion 3072. The second rear supporting rod 602 has one end movably coupled to the tenth pivotal connection portion 3073. Therefore, regardless of whether the folding chair is folded or unfolded, the fourth fitting portion 3071 of the right back rest rod sliding element 307 slides downward or upward along the right back rest rod 306. Hence, owing to the ninth pivotal connection portion 3072 and the tenth pivotal connection portion 3073, the right front leg rod 308 moves toward the right rear leg rod 304 or moves away from the right rear leg rod 304; meanwhile, the second rear supporting rod 602 moves toward the left lateral folding mechanism 10 or moves away from the left lateral folding mechanism 10. Therefore, not only does the right back rest rod sliding element 307 move smoothly, but the right back rest rod 306, the right front leg rod 308 and the second rear supporting rod 602 also demonstrate high stability and high load-bearing capability after the folding chair has been unfolded.

In an embodiment of the present disclosure, as shown in FIG. 1, the load-bearing structure 70 comprises a sitting portion 701 and a back rest portion 702. The sitting portion 701 is disposed at the left frame rod 101 and the right frame rod 301. The back rest portion 702 is disposed at the left back rest rod 106 and the right back rest rod 206. The back rest portion 702 is connected to the sitting portion 701. Therefore, the sitter can sit at the sitting portion 701 and has his/her back pressed against the back rest portion 702, thereby enhancing user experience.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A folding chair, comprising:

a left lateral folding mechanism comprising a left frame rod, a left frame rotating element, a left rear leg sliding element, a left rear leg rod, a left rear leg fixing element, a left back rest rod, a left back rest rod sliding element, a left front leg rod, a left front leg terminal, a left connecting rod and a left rear leg terminal, the left frame rotating element being movably coupled to vicinity of an end of the left frame rod, the left rear leg sliding element being movably coupled to another end of the left frame rod, the left rear leg rod being movably, penetratingly disposed at the left rear leg sliding element, the left rear leg fixing element being movably coupled to an end of the left rear leg rod, the left back rest rod having an end movably coupled to the left frame rod, the left rear leg fixing element being disposed at vicinity of an end of the left back rest rod, the left back rest rod sliding element being movably fitted to the left back rest rod, the left front leg rod having an end movably coupled to the left back rest rod sliding element, the left front leg terminal being movably coupled to another end of the left front leg rod, the left connecting rod having an end movably coupled to the left rear leg rod, the left connecting rod having another end movably coupled between the left frame rod and the left front leg rod, the left rear leg terminal being movably coupled to another end of the left rear leg rod;

a left handrail mechanism connected to the left lateral folding mechanism and comprising a left handrail rod, a left handrail fixing element, a left handrail supporting rod and a left supporting rod sliding element, the left handrail rod having an end movably coupled to the left back rest rod, the left frame rotating element being disposed at the left handrail supporting rod, the left handrail fixing element being disposed at vicinity of another end of the left handrail rod, the left handrail supporting rod having an end movably coupled to the left handrail fixing element, the left supporting rod sliding element being coupled to another end of the left handrail supporting rod, and the left supporting rod sliding element being movably fitted to the left front leg rod;

a right lateral folding mechanism opposingly disposed on a side of the left lateral folding mechanism and comprising a right frame rod, a right frame rotating element, a right rear leg sliding element, a right rear leg rod, a right rear leg fixing element, a right back rest rod, a right back rest rod sliding element, a right front leg rod, a right front leg terminal, a right connecting rod and a right rear leg terminal, the right frame rotating element being movably coupled to vicinity of an end of the right frame rod, the right rear leg sliding element being movably coupled to another end of to the right frame rod, the right rear leg rod being movably, penetratingly disposed at the right rear leg sliding element, the right rear leg fixing element being movably coupled to an end of the right rear leg rod, the right back rest rod having an end movably coupled to the right frame rod, the right rear leg fixing element being disposed at vicinity of an end of the right back rest rod, the right back rest rod sliding element being movably fitted to the right back rest rod, the right front leg rod having an end movably coupled to the right back rest rod sliding element, the right front leg terminal being movably coupled to another end of the right front leg rod, the right connecting rod having an end movably coupled to the right rear leg rod, the right connecting rod having another end movably coupled between the right frame rod and the right front leg rod, and the right rear leg terminal being movably coupled to another end of the right rear leg rod;

a right handrail mechanism connected to the right lateral folding mechanism, opposing the left handrail mechanism, and comprising a right handrail rod, a right handrail fixing element, a right handrail supporting rod and a right supporting rod sliding element, the right handrail rod having an end movably coupled to the right back rest rod, the right frame rotating element being disposed at the right handrail supporting rod, the right handrail fixing element being disposed at vicinity of another end of the right handrail rod, the right handrail supporting rod having an end movably coupled to the right handrail fixing element, the right supporting rod sliding element being coupled to another end of the right handrail supporting rod, and the right supporting rod sliding element being movably fitted to the right front leg rod;

a front supporting mechanism disposed between the left lateral folding mechanism and the right lateral folding mechanism and comprising a first front supporting rod and a second front supporting rod, wherein the first front supporting rod and the second front supporting rod cross each other so as to be movably coupled together, the first front supporting rod having an end movably coupled to the left frame rotating element, the first front supporting rod having another end movably coupled to the right front leg terminal, the second front supporting rod having an end movably coupled to the right frame rotating element, and the second front supporting rod having another end movably coupled to the left front leg terminal;

a rear supporting mechanism disposed between the left lateral folding mechanism and the right lateral folding mechanism and comprising a first rear supporting rod and a second rear supporting rod, wherein the first rear supporting rod and the second rear supporting rod cross each other so as to be movably coupled together, the first rear supporting rod having an end movably coupled to the left back rest rod sliding element, the first rear supporting rod having another end movably coupled to the right rear leg terminal, the second rear supporting rod having an end movably coupled to the right back rest rod sliding element, and the second rear supporting rod having another end movably coupled to the left rear leg terminal; and a load-bearing structure disposed at the left lateral folding mechanism and the right lateral folding mechanism.

2. The folding chair of claim 1, wherein the left frame rotating element has a first pivotal connection portion and a first straddling portion, the first straddling portion being disposed on a top surface of the first pivotal connection portion, the first front supporting rod having an end movably coupled to the first pivotal connection portion, with the left frame rod movably coupled to the first straddling portion.

3. The folding chair of claim 1, wherein the left rear leg sliding element has a first fitting portion and a second pivotal connection portion, the second pivotal connection portion being disposed at an end of the first fitting portion, the left rear leg rod being movably, penetratingly disposed at the first fitting portion, the left frame rod having another end movably coupled to the second pivotal connection portion.

4. The folding chair of claim 1, wherein the left rear leg fixing element has a second securing portion and a third pivotal connection portion, the second securing portion being disposed at an end of the third pivotal connection portion, the second securing portion being coupled to vicinity of an end of the left back rest rod, and the left rear leg rod having an end movably coupled to the third pivotal connection portion.

5. The folding chair of claim 1, wherein the left back rest rod sliding element has a second fitting portion, a fourth pivotal connection portion and a fifth pivotal connection portion, the fourth pivotal connection portion being disposed at an end of the second fitting portion, the fifth pivotal connection portion being disposed on a side of the second fitting portion, the left back rest rod being movably, penetratingly disposed at the second fitting portion, the left front leg rod having an end movably coupled to the fourth pivotal connection portion, and the first rear supporting rod having an end movably coupled to the fifth pivotal connection portion.

6. The folding chair of claim 1, wherein the right frame rotating element has a sixth pivotal connection portion and a second straddling portion, the second straddling portion being disposed on a top surface of the sixth pivotal connection portion, the second front supporting rod having an end movably coupled to the sixth pivotal connection portion, with the right frame rod movably coupled to the second straddling portion.

7. The folding chair of claim 1, wherein the right rear leg sliding element has a third fitting portion and a seventh pivotal connection portion, the seventh pivotal connection portion being disposed at an end of the third fitting portion, the right rear leg rod being movably, penetratingly disposed at the third fitting portion, wherein the right frame rod has another end movably coupled to the seventh pivotal connection portion.

8. The folding chair of claim 1, wherein the right rear leg fixing element has a fourth securing portion and an eighth pivotal connection portion, the fourth securing portion being disposed at an end of the eighth pivotal connection portion, the fourth securing portion being coupled to vicinity of an end of the right back rest rod, wherein the right rear leg rod has an end movably coupled to the eighth pivotal connection portion.

9. The folding chair of claim 1, wherein the right back rest rod sliding element has a fourth fitting portion, a ninth pivotal connection portion and a tenth pivotal connection portion, the ninth pivotal connection portion being disposed at an end of the fourth fitting portion, the tenth pivotal connection portion being disposed on a side of the fourth fitting portion, the right back rest rod being movably, penetratingly disposed at the fourth fitting portion, with the right front leg rod having an end movably coupled to the ninth pivotal connection portion, and with the second rear supporting rod having an end movably coupled to the tenth pivotal connection portion.

10. The folding chair of claim 1, wherein the load-bearing structure comprises a sitting portion and a back rest portion, the sitting portion being disposed at the left frame rod and the right frame rod, the back rest portion being disposed at the left back rest rod and the right back rest rod, with the back rest portion connected to the sitting portion.

* * * * *